US005476215A

United States Patent [19]

Baroud

[11] Patent Number: 5,476,215

[45] Date of Patent: Dec. 19, 1995

[54] PAPERBOARD FOOD HOLDER

[76] Inventor: Carum Baroud, Seven Adin Dr., Shrewsbury, Mass. 01545

[21] Appl. No.: 375,978

[22] Filed: Jan. 20, 1995

[51] Int. Cl.[6] ..... B65D 5/42; B65D 21/08

[52] U.S. Cl. ..... 229/104; 229/101; 229/108; 229/405; 229/902; 229/938

[58] Field of Search ..... 229/101, 108, 229/400, 405, 902, 906, 938, 104; 248/152, 174; 206/45.24, 45.25

[56] References Cited

U.S. PATENT DOCUMENTS

| | | | |
|---|---|---|---|
| D. 343,764 | 2/1994 | Baroud . | |
| 1,021,853 | 4/1912 | Vargyas | 229/400 |
| 1,996,431 | 4/1935 | McKichan | 229/400 |
| 2,025,280 | 12/1935 | Gregg | 248/152 |
| 2,045,746 | 6/1936 | Allison | 229/400 |
| 2,367,675 | 6/1941 | Greenleaf, 2D . | |
| 3,355,082 | 4/1965 | Wood . | |
| 3,446,416 | 11/1967 | Epstein . | |
| 3,468,317 | 9/1969 | Rowland | 229/400 |
| 4,111,352 | 9/1978 | Jergensen et al. . | |
| 4,185,764 | 1/1980 | Cote | 229/104 |
| 4,210,240 | 7/1980 | Fricano . | |
| 4,238,101 | 12/1980 | Kaye | 248/152 |
| 4,331,231 | 5/1982 | Boyle | 206/45.25 |
| 4,488,675 | 12/1984 | von Gnechten et al. . | |
| 4,509,674 | 4/1985 | Levick . | |
| 4,511,039 | 4/1985 | Siemek | 229/938 |
| 4,534,753 | 8/1985 | Kistner . | |
| 4,760,950 | 8/1988 | Levick . | |
| 4,765,533 | 8/1988 | Hoskiko et al. | 229/101 |
| 4,804,136 | 2/1989 | Hall . | |
| 4,938,515 | 7/1990 | Fazio | 229/938 |
| 5,009,362 | 4/1991 | Brangle, Jr. . | |
| 5,148,972 | 9/1992 | Clayton . | |

*Primary Examiner*—Gary E. Elkins
*Attorney, Agent, or Firm*—Banner & Allegretti, Ltd.

[57] ABSTRACT

A paperboard blank is provided which can be assembled into a self-supporting food holder for a pita bread sandwich or the like. The paperboard blank has a generally pentagonal main panel defined by score lines. Rear left-side and right-side rip-away extension panels are attached to the pentagonal rear main panel along a left-upper score line and right-upper score line, respectively. A left-side and right-side front panel are attached to the rear main panel along a left-lower score line and a right-lower score line, respectively. A front left-side rip-away extension panel and a front right-side rip-away extension panel are attached to the front panels along score lines. A stand panel is attached to the rear main panel along a center-lower score line, having (i) a center portion which is foldable to partially overlap the right-side and left-side front panels in the assembled food holder, and (ii) a stand portion which is foldable to form an integral stand to support the assembled food holder. Together with various tabs and/or other suitable means for joining panels to one another, the cut-and-scored paperboard blank can be provided as a unitary flat product which can be assembled on-site at a food service area. The assembled paperboard holder has a generally pentagonal food pocket with a flat bottom edge and a center-crested top opening. The top opening of the food pocket is extended by the aforesaid rip-away extension panels, such that it can be readily modified by hand to a smaller size.

14 Claims, 5 Drawing Sheets

PAPERBOARD FOOD HOLDER

INTRODUCTION

The present invention is directed to a cut-and-scored paperboard blank which can be assembled into a self-supporting food holder suitable for holding a pita bread sandwich or other food item, and to the assembled food holder. In particular, the invention provides a cut-and-scored paperboard blank and corresponding assembled food holder having an integral stand and food pocket size adjustment means.

BACKGROUND

Food holders have been suggested in the past which can be constructed from a paperboard blank, including, e.g. cardboard, which has been cut and scored to define various panels. A pita bread sandwich holder is shown, for example, in U.S. Pat. No. 4,760,950 to Levick. The cut-and-scored blank of Levick can be assembled in alternative orientations. Certain outer panels serve in one orientation as supports for the main food pocket, and in another orientation as a cover for the pocket.

In my U.S. Pat. No. Des. 343,764, which issued on Feb. 1, 1994, I disclosed a pita sandwich holder having a generally hexagonal food pocket (viewed from the side, as in FIG. 2 of the patent) which could be formed using suitable adhesive or other joining means from a unitary cut-and-scored paperboard blank.

The long-sustained popularity of hand-held food items in general, and the growing popularity of pita bread type sandwiches in particular, has created a need for food holders having increased functionality, especially convenience features. A food holder is needed which can be held in the hand, and which also supports itself at an inclined angle on a tabletop or other horizontal surface, to reduce or eliminate spillage of food from the food holder when it is placed down by the consumer. In addition, a need exists for a hand held food holder which can be readily modified by hand to a smaller size, either to fit a smaller food item or for adjustment by the consumer as a food item is consumed.

It is an object of the present invention to provide a paperboard blank which can be assembled into a food holder having good functionality, including self-support means and size adjustment means. These and other features and advantages of the invention will be understood from the following disclosure of the invention and detailed description of certain preferred embodiments.

SUMMARY

In accordances with a first aspect, a cut-and-scored paperboard blank is provided which can be assembled into a self-supporting food holder. The paperboard blank includes a generally pentagonal rear main panel, having a perimeter defined by various score lines, some of which, preferably, are perforated as discussed further below. The score lines which define the perimeter of the rear main panel include a left-upper score line, a right-upper score line, a left-lower score line, a right-lower score line, and a center-lower score line. A rear left-side rip-away extension panel is attached to, that is, extends from, the rear main panel along the aforesaid left-upper score line. Similarly, a rear right-side rip-away extension panel is attached to the rear main panel along its right-upper score line. Front panels are also attached to the rear main panel; that is, panels which in the assembled food holder will cooperate to form, in part, a pentagonal front main panel. Specifically, a front left-side front panel is attached to the rear main panel along its left-lower score line. A right-side front panel is attached to the rear main panel along its right-lower score line. Each of the two front panels has a rip-away extension panel attached to it. Specifically, a front left-side rip-away extension panel is attached along a left flank score line of the left-side front panel. Similarly, a front right-side rip-away extension panel is attached to the right-side front panel along a right flank score line. A stand panel is attached to the rear main panel along its fifth score line, that is, its center-lower score line. The stand panel includes a center portion which is foldable to partially overlap the two front panels in the assembled food holder, such that it cooperates with the two front panels to form the generally pentagonal front main panel. The stand panel extending from the center-lower score line further includes a stand portion which is foldable to form an integral stand to support the assembled food holder. The stand portion can extend from the center portion away from the rear main panel, and typically includes tabs which can be inserted, preferably removably inserted, into corresponding slots in the front main panel of the assembled food holder to construct the stand.

It should be understood that various directional references are used here only for convenience of description. Unless specified otherwise, directional references are consistent with the orientation of the cut-and-scored paperboard blank, and the assembled paperboard holder, as illustrated in the accompanying drawings of a certain preferred embodiment. It will be clear from a reading of the detailed description which follows, that the "rear" main panel can become a "front" panel in the hands of a consumer, merely by turning around the assembled food holder. Thus, it is merely for convenience of description that the main pentagonal panel comprising the integral stand of the assembled food holder is referred to as the "front" panel of the food holder, and the opposite panel as the "rear" main panel.

In general, various attachment tabs can be included as extensions from any of the main panels, portions and segments mentioned above to aid in the assembly of the food holder from the cut-and-scored paperboard blank. The tabs may be insertable into corresponding slots, and/or adhesive may be applied to the paperboard blank to secure the various panels in assembly. It will be within the ability of those skilled in the art to select suitable pressure-sensitive adhesive, moisture-activated adhesive, etc., of which many are well known and commercially available.

The cut-and-scored paperboard blank described above can easily be assembled, either by the manufacturer of the paperboard blank, or advantageously, it can be provided as a flat, easily stacked and stored item, and then readily assembled on-site as needed, either by a food preparation worker or by the consumer. The assembled food holder, representing a second significant aspect of the invention, has excellent functionality to meet various needs of the food service industry. As mentioned above, the cut-and-scored paperboard blank provides panels which are easily assembled into an integral stand for the food holder. In accordance with preferred embodiments, the food holder stand is easily assembled and disassembled by the consumer, such that the consumer can be afforded the option of constructing the stand. In addition, the aforesaid rip-away panels allow the food service worker to adjust the size of the food holder. That is, either or both a right-side and left-side extension panel can be ripped away from the top of the generally pentagonal main food pocket to better accommodate a smaller food item. Similarly, a consumer can rip away one or both extension panels as a food item is consumed. These and additional features and advantages will be better understood from the following detailed description of certain preferred embodiments.

BRIEF DESCRIPTION OF THE DRAWINGS

Certain preferred embodiments are described below in detail, with reference to the accompanying drawings in which like reference numerals or characters represent like parts or features in FIGS. 2–7, and wherein.

It should be recognized that the dimensions selected for the preferred embodiment illustrated in FIGS. 1–7 are exemplary. Those skilled in the art will readily understand in view of the present disclosure and description of preferred embodiments, that alternative relative dimensions are easily accommodated without departing from the main principles of the invention.

DETAILED DESCRIPTION OF CERTAIN PREFERRED EMBODIMENTS

Figure 1:
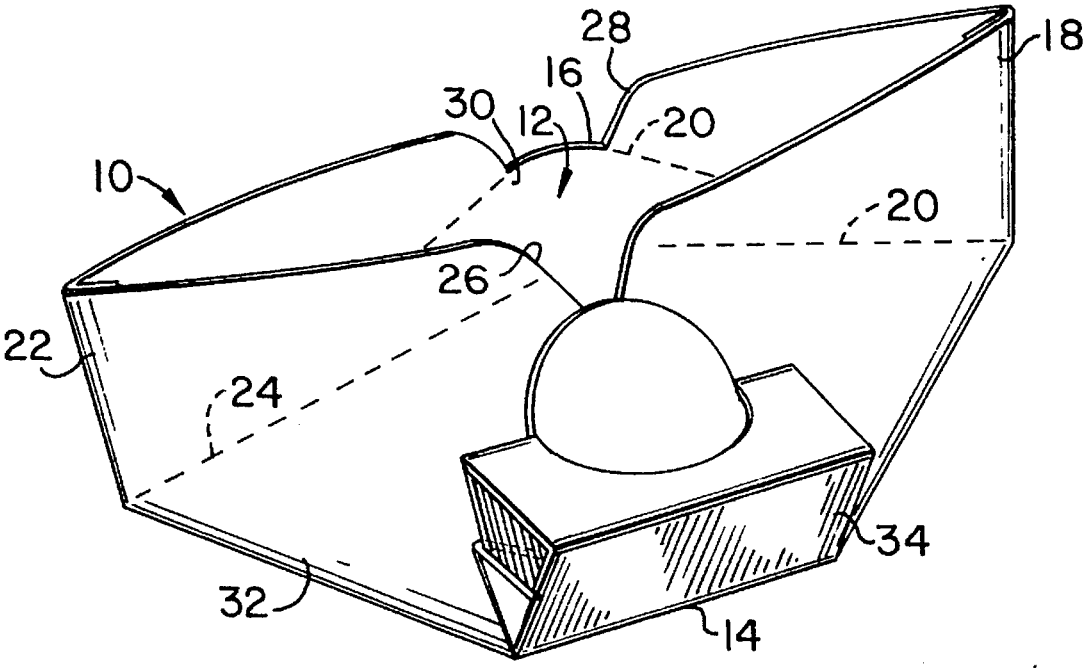
FIG. 1 is a schematic perspective view of an assembled paperboard holder in accordance with a preferred embodiment of the invention.

The assembled paperboard food holder 10 illustrated in FIG. 1 is seen to have a generally pentagonal food pocket 12, with a flat bottom edge 14 and a center-crested top opening 16. Top opening 16 of the food pocket is extended by rip-away extension panels. Specifically, a right-side rip-away extension panel 18 is connected by perforated score line 20 to the right side of the center-crested top opening. Left-side extension panel 22 is connected by perforated score line 24 to the left-side of the upper edge of the food pocket. It should be understood that with the extension panels in place, the food pocket has a generally six-sided appearance, with a flat, rather than center-crested, top opening. A front gap 26 and a rear gap 28 are provided in the preferred embodiment shown to facilitate ripping away extension panels 18 and 22 by hand. Ripping away the extension panels leaves the generally pentagonal food pocket 12 defined by rear main panel 30 and front main panel 32. As discussed further below, the front main panel 32 is assembled, adhesively or otherwise, from several panels and portions of a single unitary cut-and-scored paperboard blank. The assembled food holder is seen also to have an integral stand 34 for supporting the food holder on a tabletop or other surface. It will be readily apparent in view of the present disclosure, that the angle of incline at which the food holder is supported can be determined largely by the dimensions of the stand panel attached to the rear main panel along its center-lower score line.

The assembled food holder 10 is thus seen to have, in addition to a generally pentagonal main food pocket with a flat bottom edge, right and left rip-away extension panels for adjusting the size of the food holder, and an integral stand for supporting the food holder. The food holder thus provides advantageous functionality for improved convenience and ease of use. Significantly, such enhanced functionality is achieved in the illustrated embodiment in a food holder which can be assembled from a single, unitary cut-and-scored paperboard blank. The food holder can be held in assembly by means of suitable tabs and corresponding slots in accordance with design techniques well known to those skilled in the art. Adhesive or other adjoining means can, of course, be used either together with or in lieu of tabs and slots. In the embodiment of FIG. 1, as now discussed with reference to FIGS. 2 through 7, one exemplary arrangement of adhesive strips is used in combination with tabs of a single, unitary cut-and-scored paperboard blank.

Figure 2:
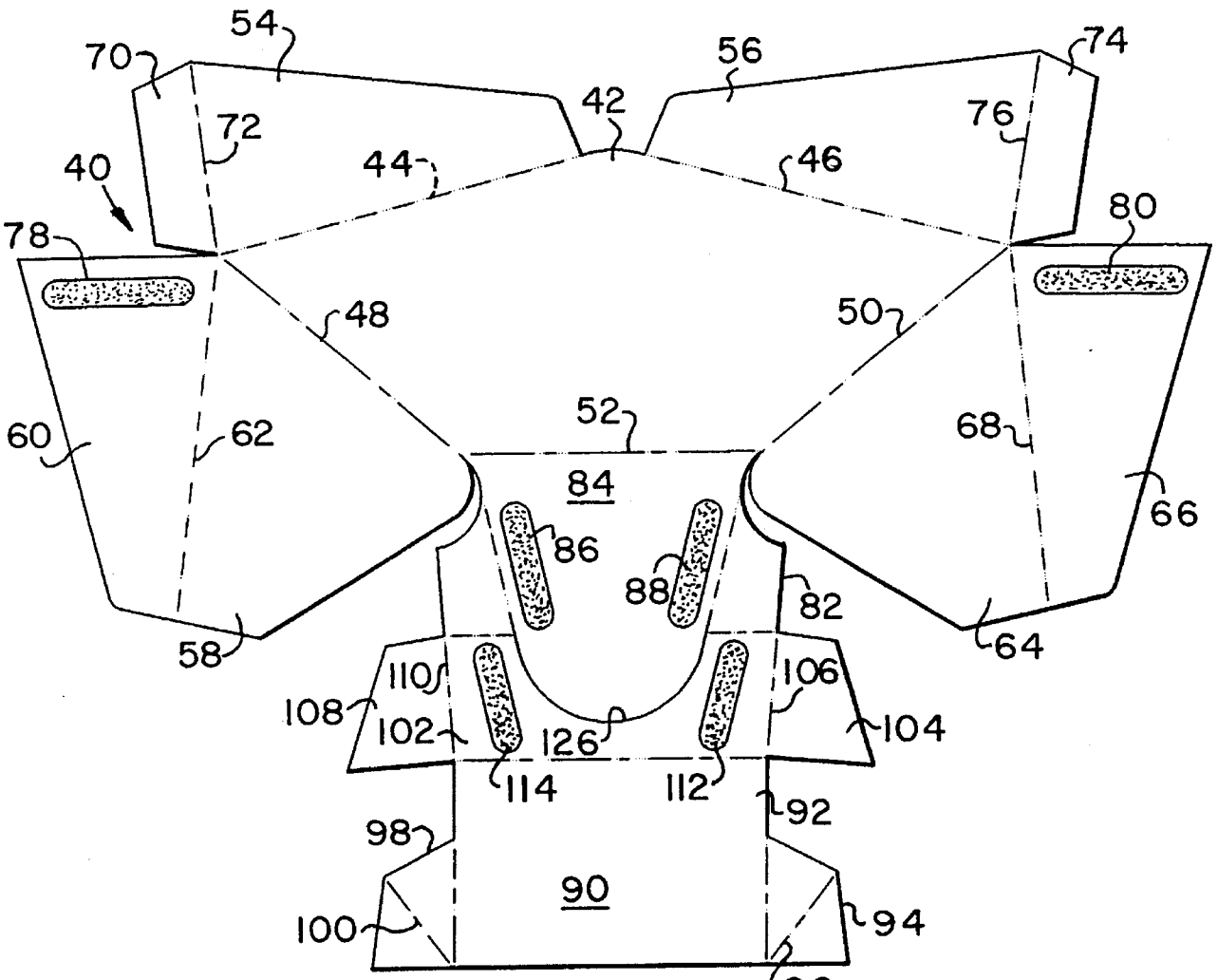
FIG. 2 is an elevation view of a cut-and-scored paperboard blank in accordance with a preferred embodiment, which is suitable to be assembled into the paperboard holder of FIG. 1.

As seen in FIG. 2, the cut-and-scored paperboard blank, which can be assembled into the food holder illustrated in FIG. 1, is a single, unitary (exclusive of various adhesive strips) flat workpiece, which is easily cut and scored from paperboard stock of various thicknesses, textures, etc. The paperboard blank 40 has a generally pentagonal rear main panel 42. Rear main panel 42 is referred to as being generally pentagonal, since its perimeter is defined generally by five score lines, including left-upper score line 44, right-upper score line 46, left-lower score line 48, right-lower score line 50, and center-lower score line 52. Right- and left-upper score lines 44, 46 together form the center-crested top opening of the main pentagonal food pocket. A rear left-side rip-away extension panel 54 is attached to the rear main panel 42 along the left-upper score line 44. Similarly, rear right-side rip-away extension panel 56 is attached to the rear main panel 42 along right-upper score line 46. A left-side front panel 58 is attached to the rear main panel 42 along the left-lower score line 48. Left-side front panel 58 has a front, left-side rip-away extension panel 60 attached along a left flank score line 62. A right-side front panel 64 is attached to the rear main panel 42 along the right-lower score line 50. A front right-side rip-away extension panel 66 is attached to the right-side front panel 64 along a right flank score line 68. The score lines by which the extension panels are connected to other panels of the cut-and-scored paperboard blank, preferably are perforated for ease of separation by hand in the assembled food holder.

As discussed further below, the rear left-side rip-away extension panel has an attachment tab 70 extending from it along a first tab score line 72. Similarly, the right-side rip-away extension panel 56 has an attachment tab 74 extending from it along a second tab score line 76. Attachment tabs 70 and 74 are used to attach the rear extension panels to the corresponding front extension panels in the assembled food holder. Adhesive strips 78 and 80 are provided on the front extension panels for this purpose. It will be readily apparent to those skilled in the art in view of the present disclosure, that the tabs and adhesive strips could as easily have been provided in reverse order, that is, the attachment tabs being provided on the front extension panels and the adhesive strips or receiving slots, etc., being provided on the rear extension panels.

The cut-and-scored paperboard blank further has a stand panel 82 attached to the rear main panel 42 along the center-lower score line 52. Stand panel 82 comprises a center portion 84 which, as discussed below, is foldable to partially overlap the right-side front panel and the left-side front panel in the assembled food holder. Attachment strips 86 and 88 are provided on the center portion for attachment to the front panels in the assembled food holder. The adhesive strips could similarly have been provided on the front panels and/or a tab and slot arrangement could be provided.

In accordance with one particularly advantageous aspect of the preferred embodiment illustrated in the drawings, the stand panel further comprises a stand portion 90 extending downwardly (as viewed in FIG. 2) from the center portion 84. The stand portion is foldable to form an integral stand to support the assembled food holder. Stand portion 90 includes support segment 92, which is adapted to provide a bottom-most support surface in the assembled food holder, that is, a surface which lies against a tabletop or the like. Support segment 92 is remote from the center-lower score line. It preferably has at least one stand tab extending from it for attachment to the main body of the food holder in its assembled form. Preferably, the stand tab is removably insertable into a slot or otherwise removably attachable to the main body of the food holder, such that the stand can be assembled and disassembled by the consumer during use. In the preferred embodiment illustrated, support segment 92 has a right-stand tab 94 extending laterally to the right of support segment 92, with a bifurcating score line 96 for ease of bending during assembly of the stand. Support segment 92 further comprises a left-stand tab 98 extending laterally to the left and having a corresponding bifurcating score line 100.

Stand portion 90 further comprises an intermediate segment 102 between the center-lower score line 52 and the support segment 92. The vertical dimension (as viewed in FIG. 2) of intermediate segment 102 will primarily determine the angle at which the assembled food holder is supported by the stand. In accordance with the preferred embodiment illustrated, intermediate segment 102 has reinforcing tabs, specifically, right reinforcing tab 104 extending from it to the right, along a right-intermediate score line 106. A corresponding left reinforcing tab 108 extends to the left from intermediate segment 102 along a left-intermediate score line 110. The two reinforcing tabs 104, 108 are foldable along their corresponding score lines to overlie and reinforce the intermediate segment 92 in the assembled food holder to prevent bending or buckling of the stand. Adhesive strips 112 and 114 are provided on intermediate segment 102 for holding the reinforcing tabs in position. The adhesive strips could, of course, have been provided on the reinforcing tabs and/or a tab and slot arrangement could be used.

Figure 3:
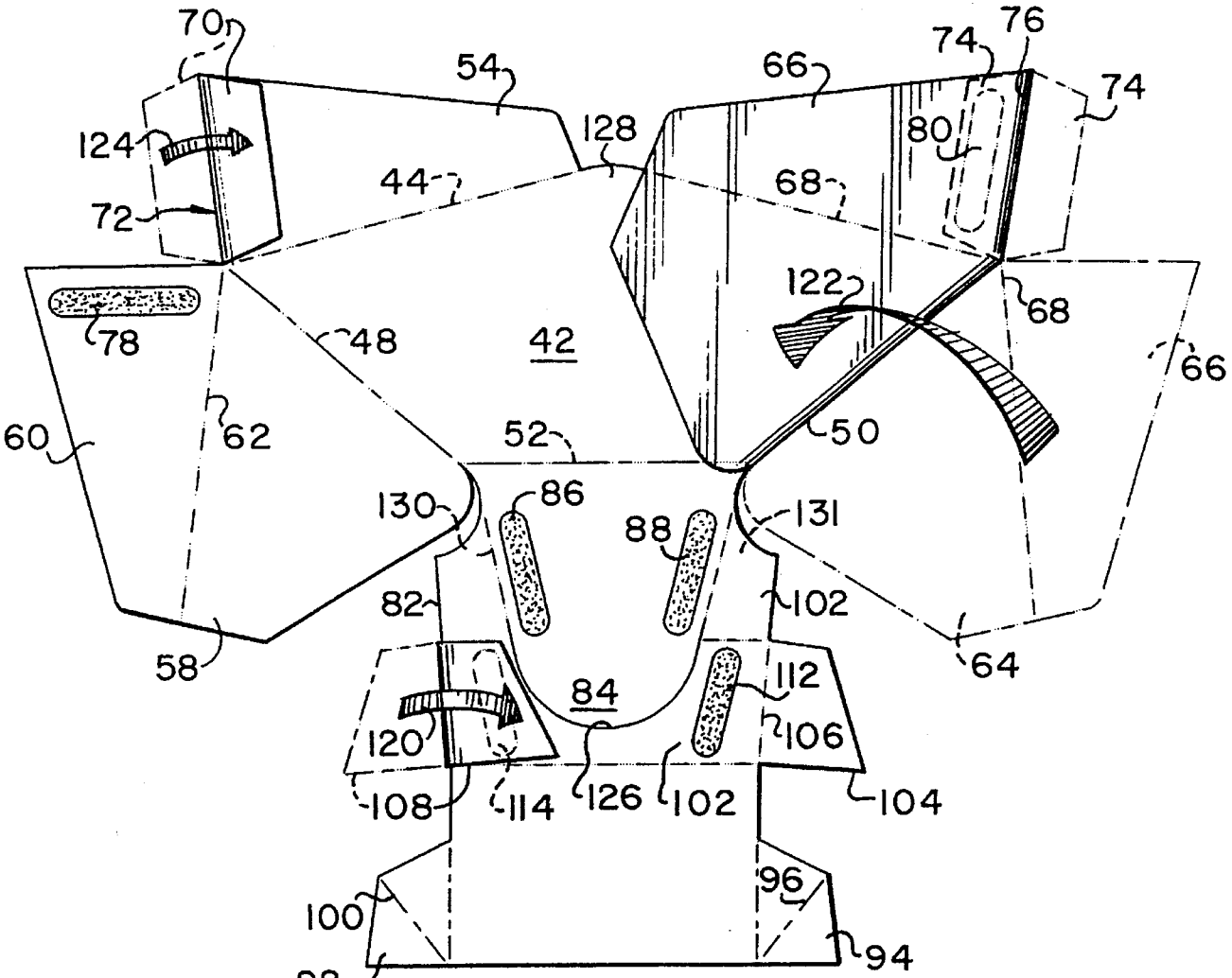
FIG. 3 is an elevation view of the cut-and-scored paperboard blank of FIG. 2, wherein certain panels have been folded to illustrate the assembly process.
Figure 4:
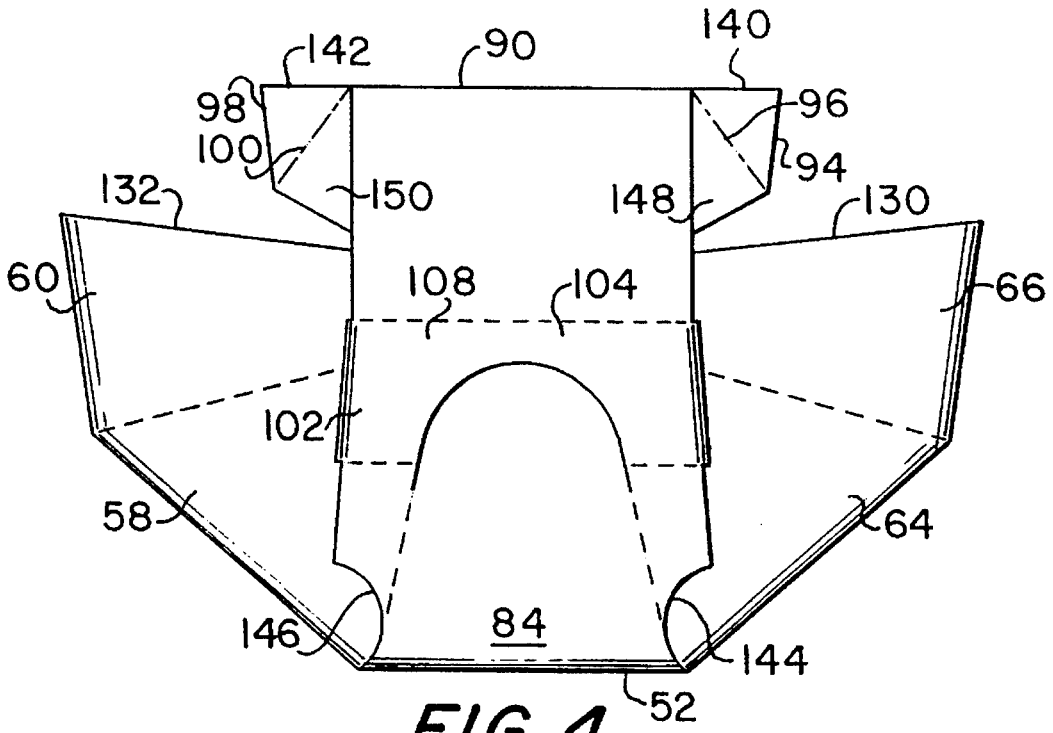
FIG. 4 is an elevation view of the cut-and-scored paperboard blank of FIGS. 2 and 3, wherein additional panels have been folded.
Figure 5:
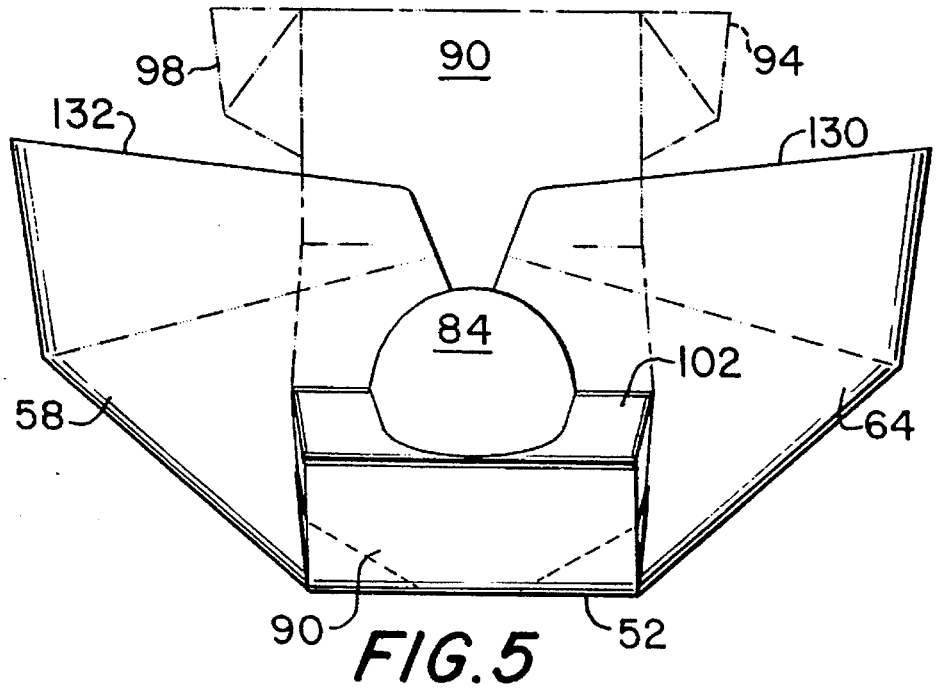
FIG. 5 is an elevation view of the cut-and-scored paperboard blank of FIGS. 2–4, wherein the assembly process has proceeded further by folding a stand portion of a stand panel to form an integral stand for the fully assembled food holder.
Figure 6:
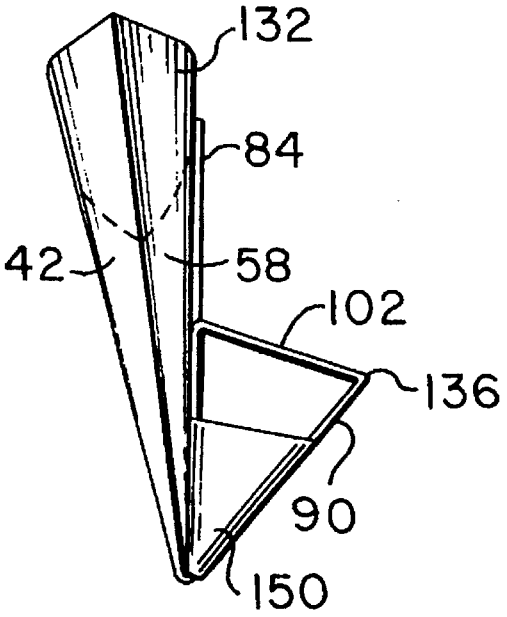
FIG. 6 is a side view of the fully assembled food holder of FIG. 5.
Figure 7:
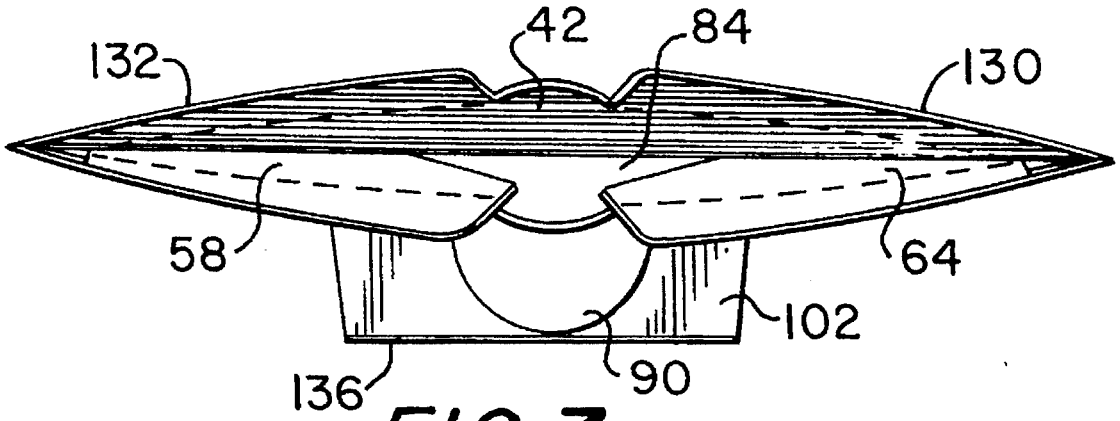
FIG. 7 is a plan view of the assembled food holder of FIGS. 5 and 6.

The paperboard blank illustrated in FIG. 2 is readily assembled, as now described, to form the food holder illustrated in FIG. 1. As seen in FIG. 3, attachment tabs 70 and 74 of the rear extension panels are folded over along their corresponding tab score lines 72 and 76. Arrow 124 shows the direction of folding left-side attachment tab 70. Front panels 58 and 64 are then folded over the main rear panel along the left-lower score line and right-lower score line, respectively. Arrow 122 shows the direction of folding right-side front panel 64 (along with its attached front extension panel 66). This will bring adhesive strips 78 and 80 of the front left-side rip-away extension panel and front right-side rip-away extension panel, respectively, into contact with the corresponding attachment tabs of the rear extension panels. By so securing the front extension panels to the rear extension panels, the left-side and right-side rip-away extension panels of the food holder are formed. After the intermediate segment 102 is separated from center portion 84, reinforcing tabs 104 and 108 can be folded over along intermediate score lines 106 and 110, respectively, to be held in position by adhesive strips 112, 114. Arrow 120 shows the direction of folding of left reinforcing tab 108 onto intermediate segment 102.

The bottom-most perimeter of center portion 84 is seen to be cut from intermediate segment 102 along a generally rounded cut line 126. Advantageously, this provides a generally symmetrical appearance for the center-crested top opening of the main pentagonal food pocket. The cut line may be extended as a perforated score line 130, 131 for ease of manufacture, although lines 130, 131 need not be scored in the illustrated embodiment.

Following the folds described above, for both right- and left-side panels of the paperboard blank, center portion 54 is folded up along center-lower score line 52. Adhesive strips 86 and 88 secure center portion 84 to the left-side front panel 58 and right-side front panel 64, respectively. The food pocket of the holder is thus formed, including both the lower pentagonal portion and the upward extensions provided by right-side rip-away extension panel 130 and left-side rip-away extension panel 132. The unitary stand of the food holder may now optionally be assembled, either by a manufacturer of the paperboard blank, by a food service worker or by the consumer. To assemble the stand, the intermediate segment and support segment of the stand panel are bent downwardly (as viewed in FIGS. 4 and 5). Support segment 90 and intermediate segment 102 bend relative to each other along score line 136. To secure the stand in its assembled position, end segments 140 and 142 of the right and left stand tabs 94 and 98, respectively, each is inserted behind center portion 84. That is, end portion 140 is inserted between center portion 84 and right-side front panel 64 at slot 144. Correspondingly, end segment 142 is inserted at slot 146. Thus, bridging segment 148 of tab 94 and bridging segment 150 of tab 98 aid in supporting the main body of the food holder and its contents. To accomplish this, the stand tabs are bent along the score line at which they are attached to main segment 90, and each is further bent along its diagonal bifurcating score line 96 and 100, respectively. Preferably, end segments 140, 142 are removably inserted into corresponding slots 144, 146, such that the stand can be easily disassembled and reassembled at the convenience of the consumer.

From the foregoing, it will be readily apparent to those skilled in the art that a food holder is provided by the present invention, having advantageous function- ality. It is assembled, at least primarily, from a single, unitary cut-and-scored paperboard blank, permitting, therefore, ease of manufacture, shipping, storage, etc., together with ease of assembly. The food holder can be assembled from the cut-and-scored paperboard blank either automatically by machine or by hand. Its size is adjustable by hand at the time of food service or during use by the consumer by removal of extension panels. An integral food stand is provided, optionally and preferably being assembleable and disassembleable by the consumer. Those who are skilled in the art will recognize that numerous modifications can be made to the preferred embodiments described above, without departing from the true scope and spirit of the invention. All such modifications are intended to be covered by the following claims.

I claim:

1. A cut-and-scored paperboard blank assembleable into a self-supporting food holder, comprising:

a generally pentagonal rear main panel having a perimeter defined by a left-upper score line, a right-upper score line, a left-lower score line, a right-lower score line and a center-lower score line;

a rear left-side rip-away extension panel attached to the rear main panel along said left-upper score line;

a rear right-side rip-away extension panel attached to the rear main panel along said right-upper score line;

a left-side front panel attached to the rear main panel along said left-lower score line, having a front left-side rip-away extension panel attached along a left flank score line;

a right-side front panel attached to the rear main panel along said right-lower score line, having a front right-side rip-away extension panel attached along a right flank score line; and a stand panel attached to the rear main panel along said center-lower score line, comprising:

a center portion foldable to partially overlap the right-side front panel and the left-side front panel in the assembled food holder, and a stand portion foldable to form an integral stand to support the assembled food holder.

2. The cut-and-scored paperboard blank in accordance with claim 1 wherein the left-upper score line, right-upper score line, left flank score line and right flank score line are perforated score lines.

3. The cut-and-scored paperboard blank in accordance with claim 1 wherein;

one of said rear left-side rip-away extension panel and front left-side rip-away extension panel, for attachment to the other, has an attachment tab extending therefrom along a first tab score line; and one of said rear right-side rip-away extension panel and front right-side rip-away extension panel, for attachment to the other, has an attachment tab extending therefront along a second tab score line.

4. The cut-and-scored paperboard blank in accordance with claim 1 wherein the center portion of the stand panel further comprises adhesive for attaching the center portion to the right-side front panel and the left-side front panel in the assembled food holder.

5. The cut-and-scored paperboard blank in accordance with claim 1 wherein the center portion has a perimeter formed in part by said center-lower score line and the stand portion comprises a support segment which is adapted to provide a bottom-most support surface in the assembled food holder, is remote from the center-lower score line, and has at least one stand tab extending therefrom for attachment to the center portion in the assembled food holder.

6. The cut-and-scored paperboard blank in accordance with claim 5 wherein a right-stand tab extends to the right of the support segment and has a bifurcating score line, and a left-stand tab extends to the left of the support segment and has a bifurcating score line.

7. The cut-and-scored paperboard blank in accordance with claim 5 wherein the stand portion further comprises an intermediate segment between the center-lower score line and the support segment.

8. The cut-and-scored paperboard blank in accordance with claim 7 wherein the intermediate segment has a right reinforcing tab extending therefrom along a right intermediate score line, and a left reinforcing tab extending therefrom along a left intermediate score line, each of said reinforcing tabs being foldable along its intermediate score line to overlie and reinforce the intermediate segment in the assembled food holder.

9. The cut-and-scored paperboard blank in accordance with claim 8 wherein the stand panel further comprises adhesive for attaching the reinforcing tabs to the intermediate segment.

10. A paperboard holder for holding a pita bread sandwich at an inclined position, consisting of a unitary cut-and-scored paperboard blank folded along score lines and held in assembled form by joining means, having:

a generally pentagonal rear main panel;

a generally pentagonal front main panel forming in cooperation with the rear main panel a generally pentagonal food pocket with a flat bottom edge and a center-crested top opening;

a right-side rip-away extension panel extending upwardly from the pentagonal food pocket along a right-side perforated score line;

a left-side rip-away extension panel extending upwardly from the pentagonal food pocket along a left-side perforated score line; and an integral stand outboard of the pentagonal food pocket.

11. The paperboard holder for holding a pita bread sandwich in in accordance with claim 10 wherein the integral stand comprises a support segment which in assembled form provides a bottom-most support surface and an intermediate segment between the support segment and the pentagonal food pocket, the support segment having at least one stand tab extending therefrom for attachment to the pentagonal food pocket.

12. The paperboard holder for holding a pita bread sandwich in accordance with claim 11 wherein a right-stand tab extends to the right from the support segment and has a diagonal bifurcating score line, and a left-stand tab extends to the left from the support segment and has a diagonal bifurcating score line.

13. The paperboard holder for holding a pita bread sandwich in accordance with claim 12 wherein the left-stand tab and the right-stand tab each is removeably insertable into corresponding slots in the pentagonal food pocket to assemble the integral stand.

14. The paperboard holder for holding a pita bread sandwich in accordance with claim 11 wherein the intermediate segment has a right-reinforcing tab extending therefrom along a right-intermediate score line, and a left-reinforcing tab extending therefrom along a left intermediate score line, the reinforcing tabs each being foldable along its corresponding intermediate score line to overlie and reinforce the intermediate segment in the assembled holder.

* * * * *